United States Patent [19]

Johenning

[11] Patent Number: 5,068,934

[45] Date of Patent: Dec. 3, 1991

[54] WATERBED MATTRESS WITH HEXAGONAL POLYPROPYLENE BAFFLE STRUCTURES

[75] Inventor: John B. Johenning, Beverly Hills, Calif.

[73] Assignee: Strata Flotation, Inc., Torrance, Calif.

[21] Appl. No.: 395,714

[22] Filed: Aug. 18, 1989

[51] Int. Cl.[5] ..... A47C 27/08

[52] U.S. Cl. ..... 5/450; 5/451

[58] Field of Search ..... 5/451, 452, 450, 422, 5/449, 441

[56] References Cited

U.S. PATENT DOCUMENTS

| | | | |
|---|---|---|---|
| 4,204,289 | 5/1980 | Fogel | 5/451 |
| 4,241,465 | 12/1980 | Yarimie et al. | 5/452 |
| 4,247,962 | 2/1981 | Hall | 5/450 |
| 4,345,348 | 8/1982 | Hall | 5/450 |
| 4,577,356 | 3/1986 | Johenning et al. | 5/450 |
| 4,663,789 | 5/1987 | Smith | 5/450 |
| 4,750,959 | 6/1988 | Johenning et al. | 156/145 |

*Primary Examiner*—Alexander Grosz

*Attorney, Agent, or Firm*—Flehr, Hohbach, Test, Albritton & Herbert

[57] ABSTRACT

Waterbed mattress having a baffle structure comprising a buoyant pad of polypropylene foam adapted to float within the mattress, and a plurality of hexagonal cells having side and bottom walls of polypropylene depending from the buoyant pad. The cells are arranged in a honeycomb array with the side walls of adjacent ones of the cells facing each other in a closely spaced parallel relationship.

14 Claims, 2 Drawing Sheets

WATERBED MATTRESS WITH HEXAGONAL POLYPROPYLENE BAFFLE STRUCTURES

This invention pertains generally to waterbeds and, more particularly, to a waterbed mattress having a baffle structure for reducing wave motion in the water within the mattress.

Since waterbeds became popular about 20 years ago, a number of different baffle structures have been provided in an effort to eliminate, or at least reduce, the wave motion which some people find disturbing. Early efforts involved the use of vertically extending baffles which were connected to the upper wall of the mattress and produced an undesirable pulling or tensioning of the sleeping surface. More recently, mattresses with horizontally extending baffles which are free of connection to the top wall have been provided. Examples of such mattresses where the baffles are connected to the bottom and side walls are found in U.S. Pat. Nos. 4,247,962 and 4,345,348.

U.S. Pat. 4,204,289 describes a waterbed mattress having cylindrical damper baffles affixed to the bottom wall of the mattress for reducing wave action in the water, and U.S. Pat. 4,577,356 and 4,750,959 describe mattresses having hemispherical baffle chambers suspended from the under side of a horizontally extending baffle.

Baffle structures have commonly been fabricated of the same type of material as the surrounding enclosure, e.g. polyvinylchloride (PVC). One problem with PVC baffles is that PVC tends to break down due to plasticizer migration in a waterbed, and baffle chambers made of this material may rupture or "blow out" due to the relatively high pressures which are exerted on them when people get onto and move about the mattress. This problem has been solved to some extent by fabricating the baffles of polyethylene as described in U.S. Pat. Nos. 4,577,356 and 4,750,959. The polyethylene baffles tend to elongate or stretch rather than blowing out, and while this is an improvement, it is still not the ideal solution.

Another problem with the baffled mattresses heretofore provided is that they have not been totally effective in eliminating wave action. With straight or curved baffles, the wave patterns tend to be transmitted across the surfaces of the baffles rather than being broken up.

It is in general an object of the invention to provide a new and improved waterbed mattress having a baffle structure for reducing wave motion within the mattress.

Another object of the invention is to provide a mattress of the above character which overcomes the limitations and disadvantages of baffled mattresses heretofore provided.

These and other objects are achieved in accordance with the invention by providing a waterbed mattress having a baffle structure comprising a buoyant pad of polypropylene foam adapted to float within the mattress, and a plurality of hexagonal cells having side and bottom walls of polypropylene depending from the buoyant pad. The cells are arranged in a honeycomb array with the side walls of adjacent ones of the cells facing each other in a closely spaced parallel relationship.

FIG. 1 is an isometric view, partly broken away, of one embodiment of a waterbed mattress incorporating the invention.

FIG. 2 a cross-sectional view of one of the cells in the baffle structure in the embodiment of FIG. 1.

Figure 1:
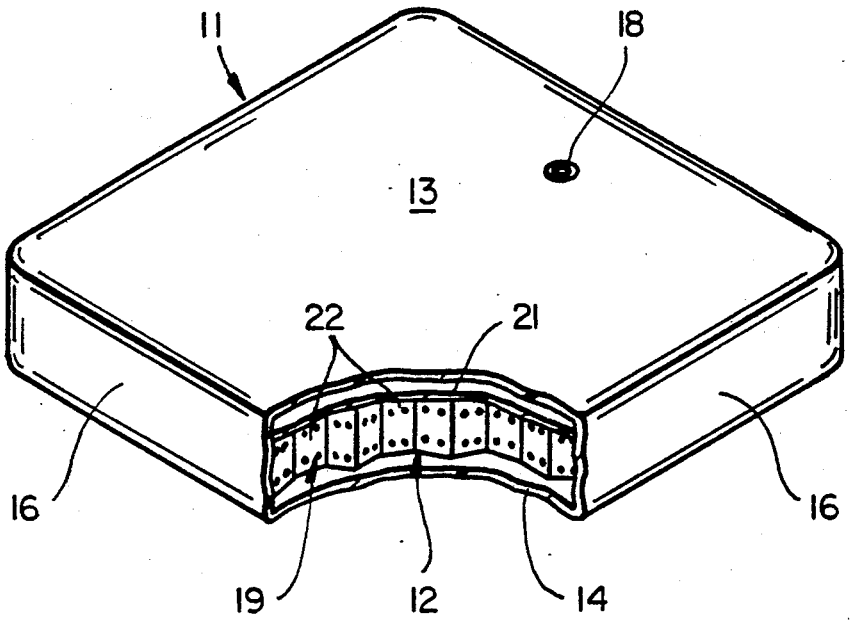

As illustrated in FIG. 1, the mattress comprises a generally rectangular enclosing structure 11 and a body of water 12 which is contained within the enclosure. The enclosure can be fabricated of any suitable flexible material such as vinyl and includes a top wall 13, a bottom wall 14 and side walls 16. The top wall is adapted for receiving persons in sitting and reclining positions and is sometimes referred to as the sleeping surface of the mattress. A valve 18 is provided in the top wall for introducing water into and removing water from the mattress.

A baffle structure 19 is disposed within the enclosure to reduce the wavelike motion of the water within the mattress. This structure includes a horizontally extending pad 21 of buoyant material which floats in the water below the top wall 13 of the enclosure. In one presently preferred embodiment, the pad has a thickness on the order of ¼ inch and a horizontal area corresponding to the sleeping surface of the mattress. Thus, for example, in a king size mattress measuring 84 by 72 inches, the pad has a length of 84 inches and a width of 72 inches. In other embodiments, the pad may range in thickness from about 1/16 inch to about 1 inch.

A plurality of hexagonal cells 22 depend from the under side of pad 21. Each of these cells has six side walls 23 and a hexagonal bottom wall 24. The upper margins of the side walls of each cell are sealed to the pad along a hexagonal path, and the lower margins of the side walls are sealed to the marginal edge portions of the bottom wall to form a closed chamber. Openings 26 are provided in the side and bottom walls permit a limited flow of water into and out of the cells. In one presently preferred embodiment, each of the cells has height on the order of 7 ½ inches, a corner-to-corner (major) diameter of 11 ¾ inches, a side-to-side (minor) diameter of 10 ⅛ inches, and a side wall width of 5 7/8 inches, with openings 26 having a diameter on the order of ½ inch.

The six side walls in each cell are formed by a strip of flexible material which extends circumferentially of the cell, with the ends of the strip being sealed together on one side of the cell. Alternatively, the side walls can be formed from a length of tubing, and if the tubing is extruded, no seams are required in the side walls.

Figure 3:
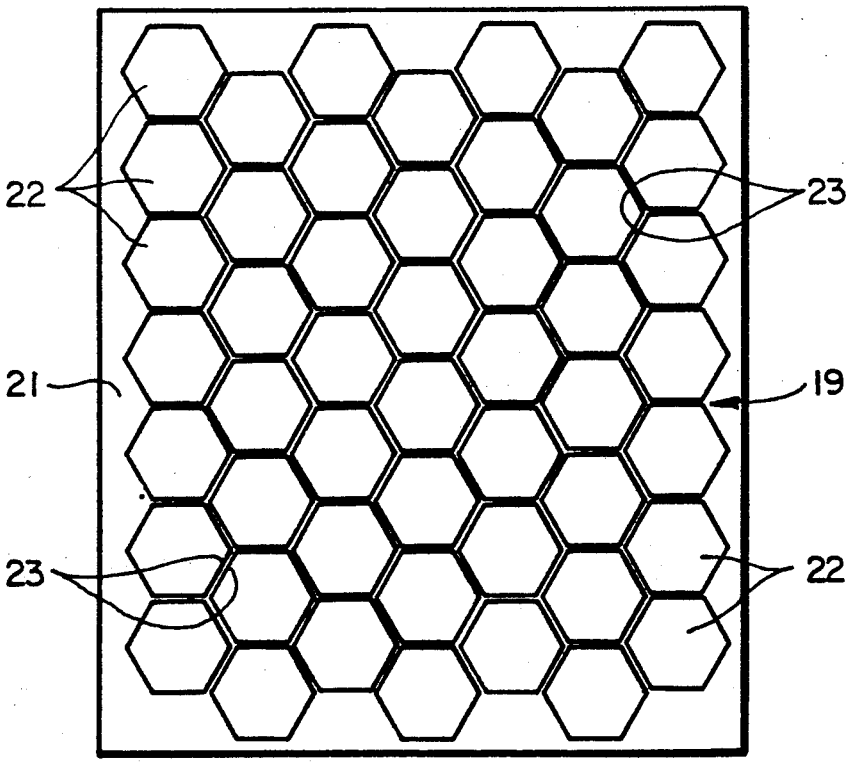
FIG. 3 is a diagrammatic view illustrating the arrangement of the cells in the embodiment of FIG. 1.
Figure 2:
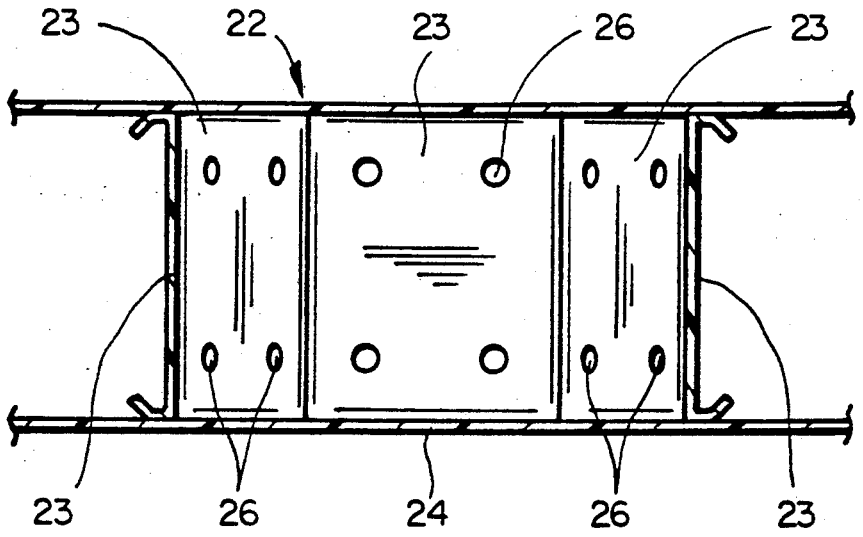

As best seen in FIG. 3, the cells 22 are arranged in a honeycomb array, with the side walls of adjacent ones of the cells facing each other in closely spaced parallel relationship. With cells having the dimensions given in the example above, the facing walls of the adjacent cells are separated by a distance on the order of ½ inch. The embodiment illustrated in FIG. 3 has a total of 49 cells arranged in seven rows of seven cells each. The rows extend lengthwise of the mattress, with alternate ones of the rows being offset from the others by a distance equal to one-half of the minor diameter of the cells plus one-half of the distance between the side walls of the adjacent cells. The 49 cell array is intended for use in a king size mattress. Similar arrays having a smaller number of cells can be utilized in other sizes of mattresses. Thus, for example, an array for a super single size mattress might have five rows of seven cells, and an array for a queen size mattress might have six rows of seven cells.

The hexagonal cells and honeycomb array have been found to provide a surprising improvement in the reduction of wave action in comparison with mattresses having rounded or hemispherical baffle chambers. This is believed to be due to the fact that the hexagonally arranged surfaces break up the wave patterns which tend to travel across straight or curved baffle surfaces.

The baffle structure is fabricated of polypropylene, with pad 21 being fabricated of a buoyant polypropylene foam and cell walls 23, 24 being fabricated of polypropylene film or sheeting, and the seams between the pad, the side walls and the bottom walls of the cells being made by heat sealing. The film used for the bottom walls has a density greater than that of water so the cells hang from the pad in the water with the side walls in an extended condition. If desired, the side wall can also be fabricated of a material having a density greater than that of water. A suitable high density film having a specific gravity or density greater than that of water can be formed by adding a filler material such as carbon to the polypropylene during the manufacture of the film.

The polypropylene has been found to provide a significant improvement over the materials heretofore utilized in baffle structures. It is substantially stronger than either polyvinylchloride or polyethylene, and it does not stretch like polyethylene, as can be seen from the following table:

| Material | Tensile Strength | Elongation | Tear Resistance |
|---|---|---|---|
| Polypropylene | 7500–40,000 | 35–475 | 1000–1500 |
| PVC | 1400–10,000 | 100–500 | 110–290 |
| Polyethylene | 1500–4000 | 100–700 | 65–575 |

where tensile strength is in pounds per square inch, elongation is in percent, and tear resistance is initial tear resistance in pounds per inch. With a polypropylene baffle structure, there is no tendency for the cells to blow out or rupture from the pressure which is exerted on them when a person gets onto or moves about the mattress, and there is no appreciable stretching or elongation of the cells.

Figure 4:
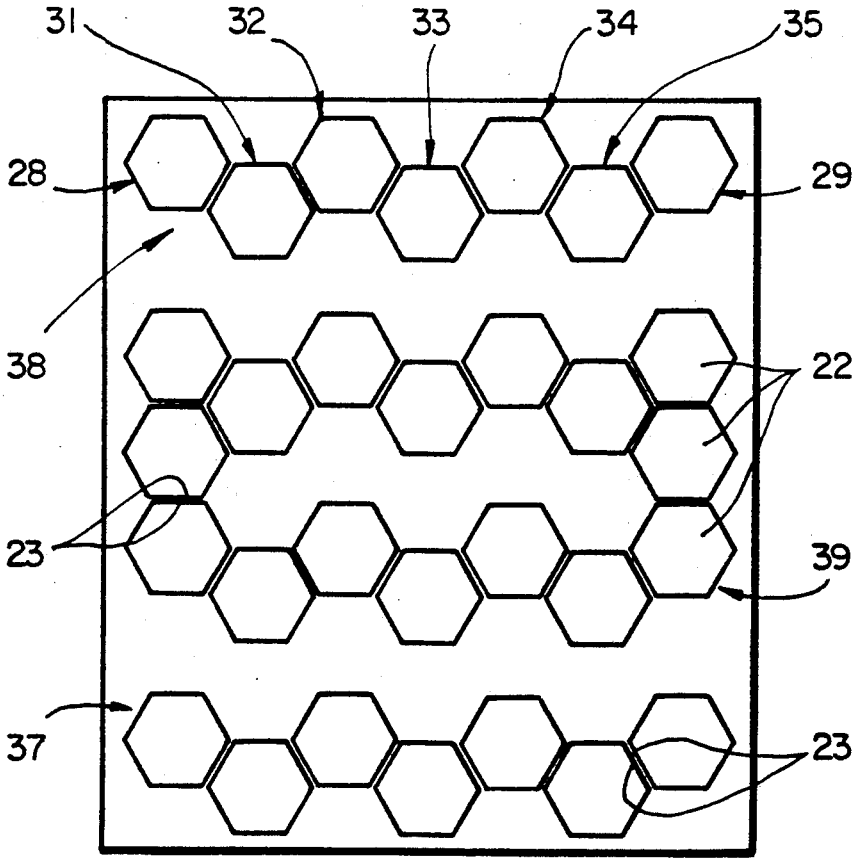
FIG. 4 is a diagrammatic view of another arrangement of cells which can be utilized in the embodiment of FIG. 1.

FIG. 4 illustrates an array of 30 cells for use in a king size bed. This array includes two outer rows 28, 29 of five cells each and five inner rows 31–35 of four cells each. Each of the rows has four cells spaced one cell apart, and the two outer rows each have an additional cell which is closely spaced between the other two inner cells in the row. As in the embodiment of FIG. 3, alternate ones of the rows are offset, and this results in a pattern in which the outer cells form closely spaced groups 37, 38 which extend across the head and foot of the mattress and the inner cells form a generally rectangular, open grouping 39 which extends across the central portion of the mattress. This array is similar to the honeycomb array of FIG. 3 with some of the cells omitted.

An array of cells similar to that shown in FIG. 4 can also be employed in mattresses of different sizes. A super single mattress, for example can have four rows of cells arranged in this configuration, and queen size mattress can have five rows.

It is apparent from the foregoing that a new and improved mattress for waterbeds has been provided. While only certain presently preferred embodiments have been described in detail, as will be apparent to those familiar with the art, certain changes and modifications can be made without departing from the scope of the invention as defined by the following claims.

I claim:

1. In a waterbed mattress: an enclosure for holding a body of water, a buoyant pad of polypropylene foam adapted to float within the enclosure, and a plurality of hexagonal cells having side and bottom walls of polypropylene depending from the buoyant pad, the polypropylene in at least the lower portions of the cells having a density greater than that of water so that the cells hang from the pad with the side walls in an extended condition when the enclosure is filled with water.

2. The waterbed mattress of claim 1 wherein the cells are arranged in a honeycomb array in which the side walls of adjacent ones of the cells face each other in closely spaced parallel relationship.

3. The waterbed mattress of claim 1 wherein the side walls of each of the cells are formed by a strip of polypropylene which extends circumferentially of the cell, with the ends of the strip being sealed together on one side of the cell.

4. The waterbed mattress of claim 1 wherein the side walls of each of the cells are formed as an integral structure by a length of polypropylene tubing.

5. In a waterbed mattress: an enclosure for holding a body of water, a buoyant pad of polypropylene foam adapted to float within the mattress, and a plurality of cells having walls of polypropylene depending from the pad.

6. The waterbed mattress of claim 5 wherein each of the cells has six side walls sealed to the pad along a hexagonal path, and a hexagonal bottom wall sealed to the lower portions of the side walls.

7. The waterbed mattress of claim 5 wherein the walls of each of the cells are formed by a strip of polypropylene which extends circumferentially of the cell, with the ends of the strip being sealed together on one side of the cell.

8. The waterbed mattress of claim 5 wherein the walls of each of the cells are formed as an integral structure by a length of polypropylene tubing.

9. In a waterbed mattress: an enclosure for holding a body of water, a buoyant pad of polypropylene adapted to float within the enclosure, and a plurality of hexagonal cells depending from the pad, each of said cells having six side walls fabricated of polypropylene and sealed to the pad along a hexagonal path, a hexagonal bottom wall fabricated of polypropylene and sealed to the lower portions of the side walls, and openings in at least some of the walls permitting limited water movement into and out of the cells, said cells being arranged in a honeycomb array with the side walls of adjacent ones of the cells facing each other in a closely spaced parallel relationship.

10. In a waterbed mattress: an enclosure for holding a body of water, a buoyant pad of polypropylene adapted to float within the enclosure, and a plurality of multifaceted cells depending from the pad, each of said cells having a plurality of side walls fabricated of polypropylene and sealed to the pad along a closed path, a bottom wall fabricated of polypropylene and sealed to the lower portions of the side walls, and openings in at least some of the walls permitting limited water movement into and out of the cells, said cells being arranged in a honeycomb-like array with the side walls of adjacent ones of the cells facing each other in a closely spaced parallel relationship.

11. In a waterbed mattress: an enclosure for holding a body of water, a buoyant pad adapted to float within the enclosure, and a plurality of hexagonal cells depending from the pad, each of said cells having six side walls formed as an integral structure by a length of polypropylene tubing sealed to the pad along a hexagonal path, a hexagonal bottom wall sealed to the lower portions of the side walls, and openings in at least some of the walls permitting limited water movement into and out of the cells, said cells being arranged in a honeycomb array with the side walls of adjacent ones of the cells facing each other in a closely spaced parallel relationship.

12. In a waterbed mattress: an enclosure for holding a body of water, a buoyant pad adapted to float within the enclosure, and a plurality of multifaceted cells depending from the pad, each of said cells having a plurality of side walls sealed to the pad along a closed path and being formed by a strip of polypropylene which extends circumferentially of the cell, with the ends of the strip being sealed together on one side of the cell, a bottom wall sealed to the lower portions of the side walls, and openings in at least some of the walls permitting limited water movement into and out of the cells, said cells being arranged in a honeycomb-like array with the side walls of adjacent ones of the cells facing each other in a closely spaced parallel relationship.

13. In a waterbed mattress: an enclosure for holding a body of water, a buoyant pad adapted to float within the enclosure, and a plurality of multifaceted cells depending from the pad, each of said cells having a plurality of side walls formed as an integral structure by a length of polypropylene tubing sealed to the pad along a closed path, a bottom wall sealed to the lower portions of the side walls, and openings in at least some of the walls permitting limited water movement into and out of the cells, said cells being arranged in a honeycomb-like array with the side walls of adjacent ones of the cells facing each other in a closely spaced parallel relationship.

14. In a waterbed mattress: an enclosure for holding a body of water, a buoyant pad adapted to float within the enclosure, and a plurality of hexagonal cells depending from the pad, each of said cells having six side walls sealed to the pad along a hexagonal path and being formed by a strip of polypropylene which extends circumferentially of the cell, with the ends of the strip being sealed together on one side of the cell, a hexagonal bottom wall sealed to the lower portions of the side walls, and openings in at least some of the walls permitting limited water movement into and out of the cells, said cells being arranged in a honeycomb array with the side walls of adjacent ones of the cells facing each other in a closely spaced parallel relationship.

* * * * *